US011292260B2

(12) United States Patent
Fukasawa et al.

(10) Patent No.: US 11,292,260 B2
(45) Date of Patent: Apr. 5, 2022

(54) LIQUID STORING DEVICE AND RECORDING APPARATUS

(71) Applicant: SEIKO EPSON CORPORATION, Tokyo (JP)

(72) Inventors: Koki Fukasawa, Shiojiri (JP); Nobuaki Sakai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/986,573

(22) Filed: Aug. 6, 2020

(65) Prior Publication Data

US 2021/0039395 A1 Feb. 11, 2021

(30) Foreign Application Priority Data

Aug. 9, 2019 (JP) ..... JP2019-147223

(51) Int. Cl.
*B41J 2/175* (2006.01)
*B41J 29/13* (2006.01)

(52) U.S. Cl.
CPC ..... *B41J 2/1754* (2013.01); *B41J 2/17553* (2013.01); *B41J 29/13* (2013.01)

(58) Field of Classification Search
CPC .... B41J 2/175; B41J 2/17503; B41J 2/17506; B41J 2/17509; B41J 2/1752; B41J 2/17523; B41J 2/17536; B41J 2/1754; B41J 2/17566; B41J 2002/17573; B41J 29/02; B41J 29/13
See application file for complete search history.

(56) References Cited

U.S. PATENT DOCUMENTS

| | | | | |
|---|---|---|---|---|
| 4,914,453 | A * | 4/1990 | Kanayama | B41J 2/175 347/86 |
| 9,707,769 | B2 * | 7/2017 | Suzuki | B41J 29/13 |
| 10,155,392 | B2 * | 12/2018 | Kamiya | B41J 2/17506 |
| 2006/0119671 | A1 * | 6/2006 | Ha | B41J 2/17509 347/84 |
| 2017/0043586 | A1 * | 2/2017 | Yanagida | B41J 2/17509 |
| 2018/0311964 | A1 | 11/2018 | Tanaka et al. | |
| 2019/0193438 | A1 * | 6/2019 | Okazawa | B41J 2/1752 |

FOREIGN PATENT DOCUMENTS

| | | |
|---|---|---|
| JP | 2016-132166 | 7/2016 |
| JP | 2018-183960 | 11/2018 |

* cited by examiner

*Primary Examiner* — Anh T Vo
(74) *Attorney, Agent, or Firm* — Workman Nydegger

(57) ABSTRACT

An ink storing device includes an ink tank having an injection port, a first cover including a cap configured to close the injection port, the first cover being movable between a closing position, and an opening position, a second cover including, at an inner face thereof, a display unit configured to display information relating to the ink, the second cover being movable between a covering position at which the inner face covers the first cover at the closing position, with the inner face being oriented downward, and a cover opening position at which the inner face does not cover the first cover at the closing position, wherein the cap, when viewed in a vertical direction, does not overlap the display unit included in the second cover at the cover opening position when the first cover moves between the closing position and the opening position.

10 Claims, 9 Drawing Sheets

LIQUID STORING DEVICE AND RECORDING APPARATUS

The present application is based on, and claims priority from JP Application Serial Number 2019-147223, filed Aug. 9, 2019, the disclosure of which is hereby incorporated by reference herein in its entirety.

BACKGROUND

1. Technical Field

The present disclosure relates to a liquid storing device, and a recording apparatus including the liquid storing device.

2. Related Art

There is described in JP 2016-132166 A, a liquid consuming apparatus including a tank having an injection port through which liquid is injected into a liquid reservoir chamber, a cap removably inserted into the injection port and configured to close the injection port, a chassis housing the tank and having an opening approaching a region, at the tank, encompassing the injection port, and a cover having a lower portion axially supported at a lower position on the tank and configured to open and close the opening by an upper portion pivotally moving with respect to the lower portion. Further, at an inner face of a lower portion of the cover of the liquid consuming apparatus, there is provided a liquid absorbing member that absorbs a liquid dropping from the injection port through an outer face of the tank when the cover is in a closing state of covering the opening.

Unfortunately, in the apparatus described in JP 2016-132166 A, the cap configured to close the injection port through which the liquid is injected can move to a position overlapping when viewed in a vertical direction with an inner face of the cover opening, thus the liquid adhering to the cap may drop off to cause the inner face of the cover to become contaminated. In contrast, by opening the cover when injecting the liquid into the tank, the inner face of the cover moves to a position at which an operator can easily see the inner face, where the position is a suitable position for affixing a label indicating guide information necessary for a liquid injecting operation, for example. That is, the apparatus described in JP 2016-132166 A has an issue in that the label may become contaminated when the inner face of the cover is used as a position for affixing a label indicating guide information.

SUMMARY

A liquid storing device of the present application includes a liquid storing unit having an injection port through which liquid is injected, a first cover including a cap configured to close the injection port, the first cover being movable between a closing position at which the cap closes the injection port, and an opening position at which the cap opens the injection port, and a second cover including, at an inner face thereof, a display unit configured to display information relating to the liquid, the second cover being movable between a covering position at which the inner face covers the first cover at the closing position, with the first cover at the closing position being located at an underside, and a cover opening position at which the inner face does not cover the first cover at the closing position, the inner face being inverted when the second cover moves between the covering position and the cover opening position, wherein the cap, when viewed in a vertical direction, does not overlap the display unit included in the second cover at the cover opening position when the first cover moves between the closing position and the opening position.

In the liquid storing device described above, the cap, when viewed in the vertical direction, may not overlap the second cover at the cover opening position when the first cover moves between the closing position and the opening position.

In the liquid storing device described above, when an angle formed by a normal line of an inner face, which is provided with the display unit of the second cover at the cover opening position, with respect to a horizontal plane is θ, there may be obtained Tan θ≥1.

In the liquid storing device described above, when the second cover is located at the covering position, the cover opening position, and a position therebetween, a position of the display unit may be located upside of the injection port in the vertical direction.

In the liquid storing device described above, the liquid storing unit may include, at a side face thereof, a view window through which an interior is viewable, wherein when viewed in a horizontal direction, the second cover at the cover opening position may not overlap the view window.

The liquid storing device may include a pivot shaft pivotally supporting the second cover between the covering position and the cover opening position, in which the second cover may include a fitting portion fitting around the pivot shaft and maintaining a fitting state by an elastic force, and a force acting against the elastic force may be exerted when a force is applied vertically downward to the second cover that is at the cover opening position.

A recording apparatus of the present application includes the liquid storing device described above, and a recording unit configured to perform recording on a recording medium by liquid supplied from the liquid storing device.

DESCRIPTION OF EXEMPLARY EMBODIMENTS

1. Embodiment 1

Figure 1:
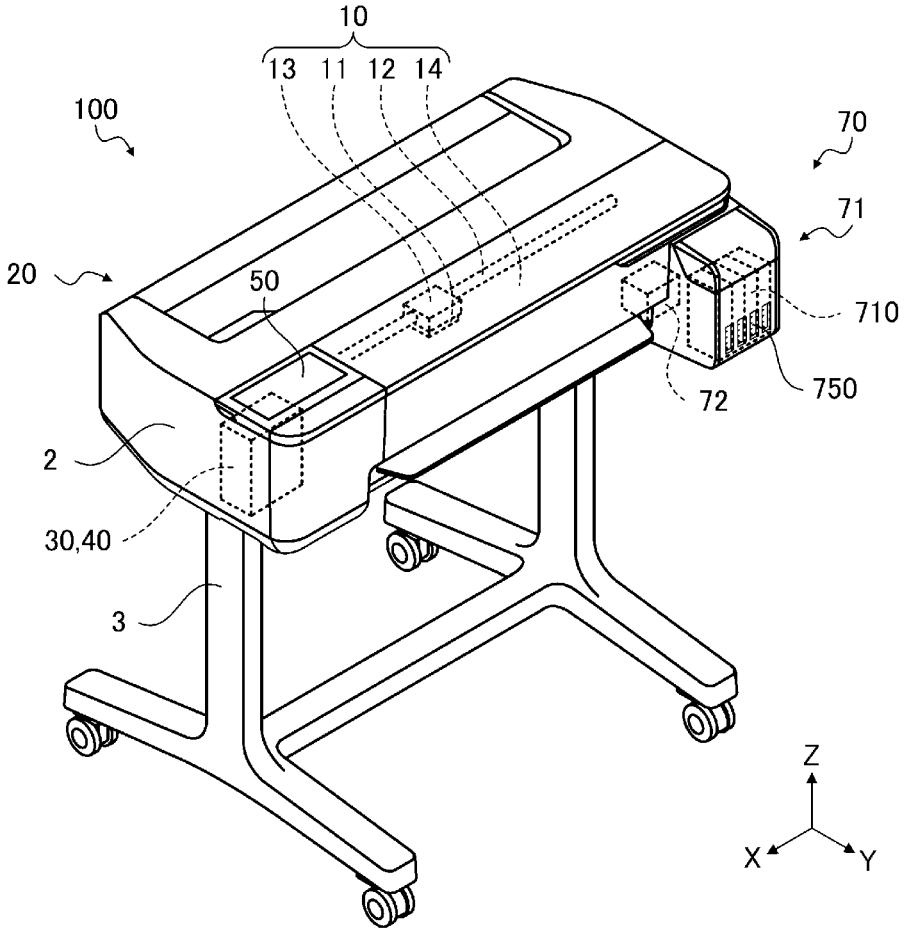
FIG. 1 is a perspective view of a printer as a recording apparatus according to Embodiment 1.
Figure 2:
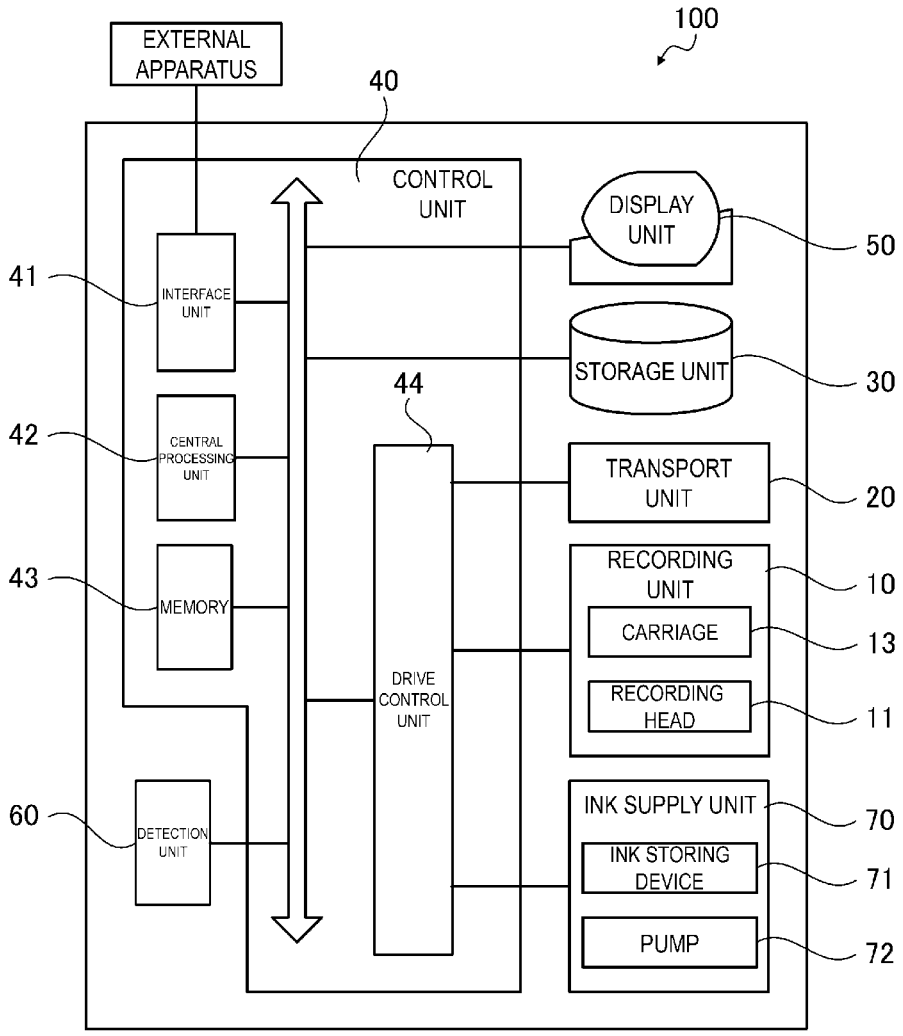
FIG. 2 is a block diagram illustrating a configuration of a printer as a recording apparatus according to Embodiment 1.

FIG. 1 is a perspective view of a printer 100 as a recording apparatus according to Embodiment 1. FIG. 2 is a block diagram illustrating a configuration of the printer 100. In the coordinates appended in the drawings, a Z-axis direction indicates a vertical direction, a +Z direction indicates an upward direction, a Y-axis direction indicates a front-rear direction, a +Y direction indicates a forward direction, an X-axis direction indicates a left-right direction, a +X direction indicates a left direction, and an X-Y plane indicates a horizontal plane.

The printer 100, which is an ink jet-type printer having a large size configured to record, for example, an image of a relatively large size such as A0 size or B0 size of JIS standard on a recording medium 1, is constituted by a main body of apparatus 2, a stand 3 for supporting the main body of apparatus 2, and the like. The main body of apparatus 2 is constituted by a recording unit 10, a transport unit 20, a storage unit 30, a control unit 40, a display unit 50, a detection unit 60, an ink supply unit 70, and the like. The recording medium 1 is housed in a state of being wound in a rolled form inside the main body of apparatus 2.

The recording unit 10 includes a recording head 11 of an ink jet-type configured to discharge an ink as a liquid onto a surface of the recording medium 1 to perform recording, a guide shaft 12 provided in a manner extending in the X-axis direction, a carriage 13, on which a recording head 11 is mounted, configured to move to perform scanning over the surface of the recording medium 1 along the guide shaft 12, a support mechanism 14 configured, at the recording unit 10, to support the recording medium 1, and the like.

The transport unit 20 configures a transport mechanism and a path from supplying the recording medium 1 on which a recording is to be performed, which is stored at a rear portion inside the main body of apparatus 2, to the recording unit 10, to discharging the recording medium 1 on which the recording has been performed from a front face of the main body of apparatus 2. With respect to the recording medium 1 supplied from the transport unit 20 to the recording unit 10, the control unit 40 alternately repeats an operation of discharging an ink droplet from the recording head 11 while causing the carriage 13 supporting the recording head 11 to move along the guide shaft 12 in the X-axis direction, and an operation of causing the transport unit 20 to move the recording medium 1 in the +Y direction intersecting the X-axis direction, to record a desired image on the recording medium 1.

The storage unit 30 is a rewritable storage medium such as a hard disk drive or a memory card. The storage unit 30 stores programs by which the control unit 40 operates, image data to be recorded, and the like.

The control unit 40, which includes an interface unit 41, a central processing unit 42, a memory 43, a drive control unit 44, and the like, performs centralized control on an entirety of the printer 100.

The interface unit 41 performs sending/receiving data between an external apparatus such as a personal computer and the printer 100, for example.

The central processing unit 42 is an arithmetic processing unit for controlling the entirety of the printer 100. The memory 43, which is a region for storing programs run by the central processing unit 42, is constituted by a storage element such as a RAM, a ROM, a flash memory, and the like.

The central processing unit 42 controls the recording unit 10, the transport unit 20, the ink supply unit 70, and the like via the drive control unit 44 in accordance with the programs, image data, and the like stored in the storage unit 30 and the memory 43.

The display unit 50, which is an input/output unit as a human interface having an input function, is constituted by a touch panel including a display and an input means. The display unit 50 is configured to select a command or an operation for the control unit 40 in accordance with a display screen.

The detection unit 60, which is constituted by a plurality of detection devices such as an encoder or optical sensor provided at predetermined locations inside the main body of apparatus 2, such as the recording unit 10, the transport unit 20, the ink supply unit 70, and the like, detects a running status within the printer 100, and outputs a result of the detection to the control unit 40. Specifically, the detection unit 60 performs surveillance on a position of the carriage 13 that moves to perform scanning along the guide shaft 12, a transport status of the recording medium 1 at the transport unit 20, a presence or absence and a remaining amount of the recording medium 1, and a presence or absence and a remaining amount of ink in the ink supply unit 70, and the like.

The ink supply unit 70, which is a part configured to supply an ink to be discharged from the recording head 11, includes an ink storing device 71 as a liquid storing device, a pump 72 configured to supply the ink from the ink storing device 71 to the recording head 11, and the like. As illustrated in FIG. 1, the ink storing device 71 is provided on the front face and a left side of the main body of apparatus 2.

Figure 3:
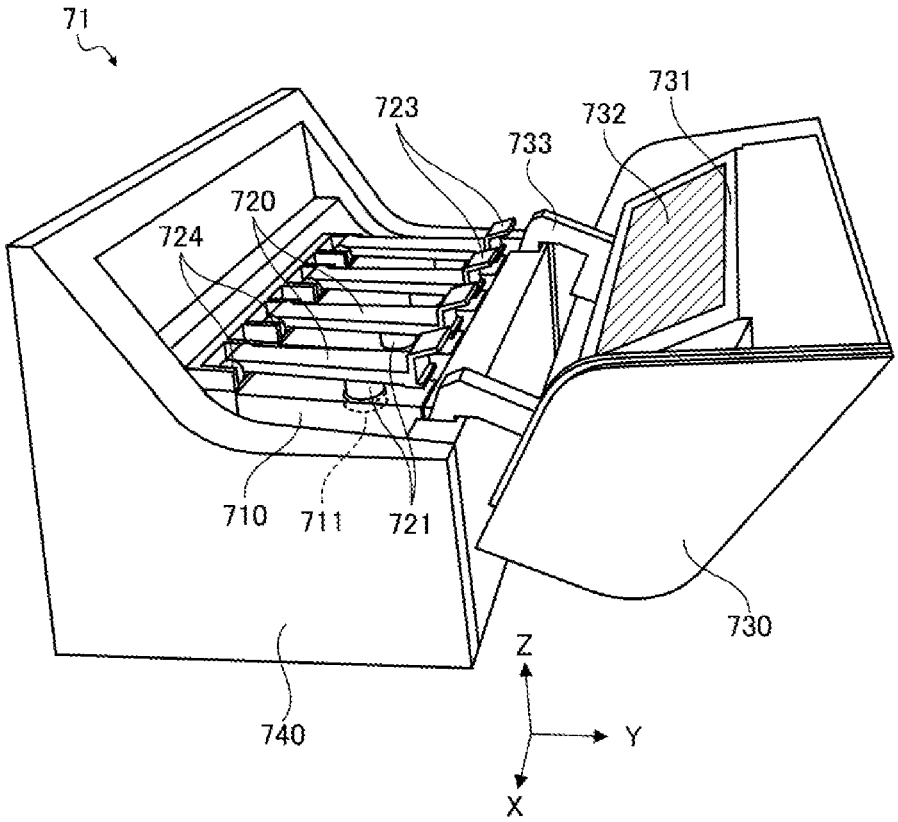
FIG. 3 is a perspective view illustrating a configuration of an ink storing device as a liquid storing device.

FIG. 3 is a perspective view illustrating a configuration of the ink storing device 71.

The ink storing device 71 is configured to include an ink tank 710 as a liquid storing unit, a first cover 720, a second cover 730, a chassis 740, and the like.

The ink tank 710, which is an approximately cuboid container for storing ink, has, at the center top, an injection port 711 through which the ink is injected. The ink tank 710 corresponds to four types of inks, which are black, magenta, yellow, and cyan inks, where four pieces of the ink tanks 710 are housed inside the chassis 740 in a manner juxtaposed in a lateral direction, that is, the X-axis direction, of the main body of apparatus 2. Note that the ink tank 710 may be an integrally configured container provided with four chambers into which four types of inks, which are black, magenta, yellow, and cyan inks, are individually injected.

The first cover 720 corresponds to the ink tanks 710 of respective colors, and includes caps 721 individually provided at upper portions of the ink tanks 710 and configured to close the injection ports 711 each corresponding to each of the caps 721. The first cover 720 is also configured to be movable between a closing position at which the caps 721 close the injection ports 711 and an opening position at which the caps 721 open the injection ports 711. Specifically, the first cover 720 is a plate shaped body extending in the Y-axis direction and being flat in an X-Y plane, where an end portion on −Y side of the first cover 720 is supported by a shaft 724, and is configured to be rotatable in a Y-Z plane. The cap 721 is also provided at a position corresponding to the injection port 711 at a lower face of the first cover 720, where the cap 721 closes the injection port 711 of the ink tank 710, which corresponds to the cap 721 when the first cover 720 is at the closing position. In addition, a pickup claw 723 is provided for facilitating an operation of causing the first cover 720 to pivotally move while removing the cap 721 that closes the injection port 711 from the injection port 711.

Figure 4:
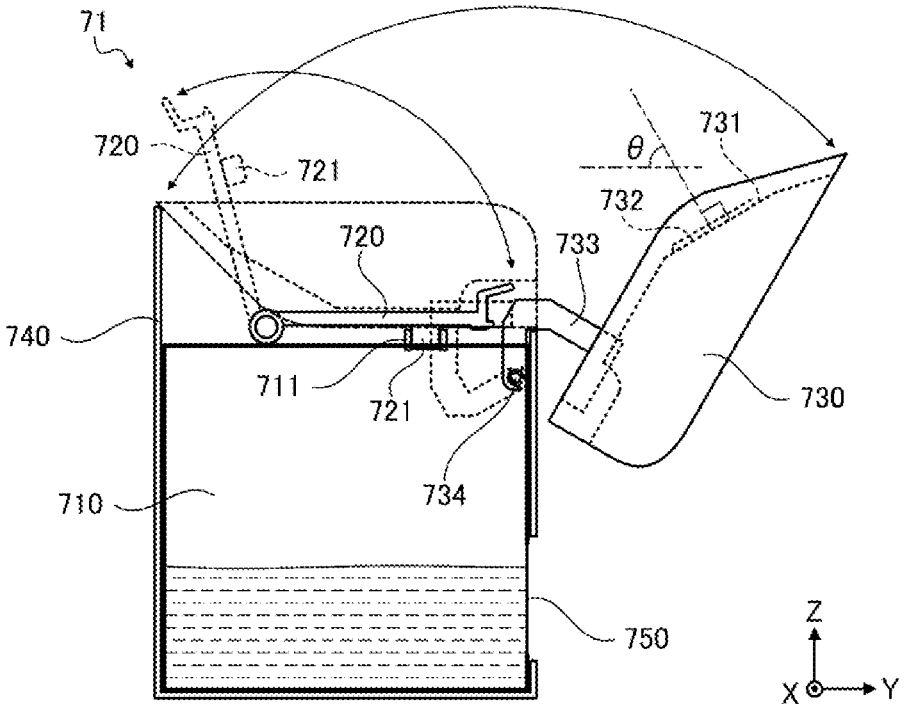
FIG. 4 is a side view conceptually illustrating a configuration of an ink storing device.

FIG. 4 illustrates a state of the first cover 720 that is pivotally moving. The first cover 720 indicated by a solid line is the first cover 720 located at the closing position, and the first cover 720 indicated by a dashed line is the first cover 720 located at the opening position. The opening position is a position at which the cap 721 opens the injection port 711, and an operation of injecting the ink can be performed without any trouble. For example, the opening position is a position at which an ink bottle, when injecting the ink from the ink bottle, can be moved to the injection port 711 without the ink bottle making contact with the first cover 720.

The second cover 730 is formed in conformance with an outer shape of the chassis 740, and is a cover that houses and covers the ink tank 710 and the first cover 720 from an upper portion to an interior of the second cover 730. The second cover 730 is configured to be movable between the covering position at which the second cover 730 covers, with the inner face being oriented downward, the first cover 720 at the closing position, and the cover opening position at which the second cover 730 avoids covering, with the inner face being tuned over with respect to the covering position, the first cover 720 at the closing position. Specifically, in the second cover 730, an end region on +Y side when the second cover 730 is located at the covering position, is supported by an arm 733 that rotates about an axis being a pivot shaft 734 provided in a manner supported by a front face, that is, an inner wall of a side face on +Y side of the chassis 740, and is configured to be rotatable in the Y-Z plane about an axis being the pivot shaft 734 together with the arm 733.

The second cover 730 indicated by a solid line in FIG. 4, is the second cover 730 located at the cover opening position, and the second cover 730 indicated by a dashed line is the second cover 730 located at the covering position. The cover opening position is a position at which the first cover 720 can be pivotally moved without at least the first cover 720 making contact with the second cover 730.

Figure 5:
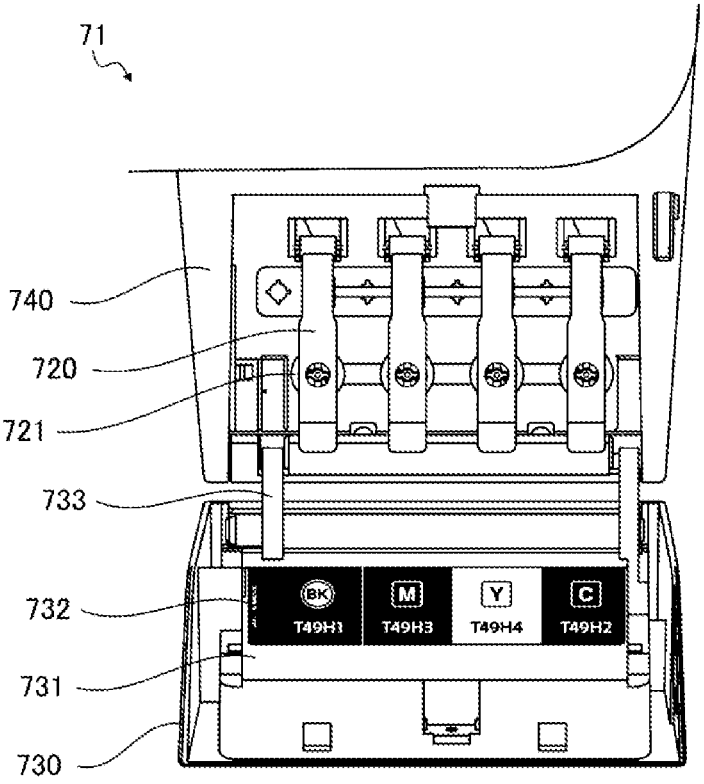
FIG. 5 is a plan view viewed from upside of an ink storing device when a second cover is located at a cover opening position.

FIG. 5 is a plan view viewed from upside of the ink storing device 71 when the second cover 730 is located at the cover opening position.

As illustrated in FIGS. 4 and 5, the second cover 730 includes, at an inner face 731 of the second cover 730, a display unit 732 configured to display information about the ink. The display unit 732 is constituted by, for example, an ink name as information about the ink, and a label for indicating an ink color.

As is also apparent from FIG. 4, the cap 721 avoids overlapping when viewed in the vertical direction with the display unit 732 included in the second cover 730 at the cover opening position during a movement of the first cover 720 between the closing position and the opening position.

Further, the cap 721 avoids overlapping when viewed in the vertical direction with the second cover 730 at the cover opening position during the movement of the first cover 720 between the closing position and the opening position.

In addition, provided that when an angle formed by a normal line of the inner face 731 provided with the display unit 732 of the second cover 730 at the cover opening position with respect to the horizontal plane is θ, there is obtained Tan θ≥1.

Further, when the second cover 730 is located at the covering position, the cover opening position, and a position in between, a position of the display unit 732 is located upside in the vertical direction of the injection port 711.

In addition, the ink tank 710 includes, at a side face, a view window 750 through which an interior is viewable, where the second cover 730 at the cover opening position avoids overlapping when viewed in the horizontal direction with the view window 750. Specifically, as illustrated in FIGS. 1 and 4, the ink tank 710 includes, in a lower region on +Y side, the view window 750 through which a reduced remaining amount within the ink tank 710 can be visually recognized. The view window 750 is composed of a substance formed of a transparent material to a degree that a remaining amount of the ink within the ink tank 710 can be visually recognized. Further, the chassis 740 is open at +Y side such that the view window 750 is not covered.

Note that the ink tank 710, rather than configured to include the view window 750, may be composed of a transparent substance to a degree that the ink inside the ink tank 710 can be visually recognized, where a window may be provided at the chassis 740 through which a lower region on +Y side of the ink tank 710 can be visually recognized.

Figure 6:
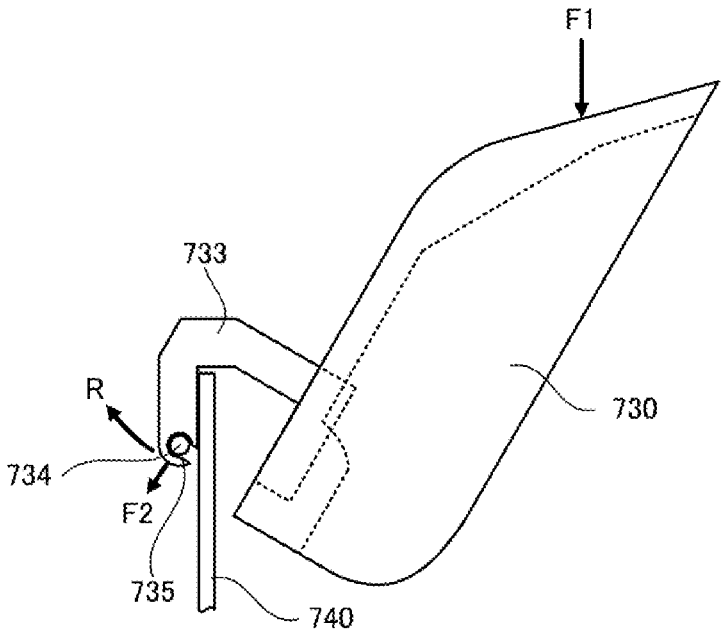
FIG. 6 is a side view illustrating a state where a second cover is being attached to a chassis of an ink storing device.

FIG. 6 is a side view illustrating a state where the second cover 730 is being attached to the chassis 740. In FIG. 6, the second cover 730 at the cover opening position is illustrated.

As described above, the second cover 730 is supported by the arm 733 that rotates about an axis being the pivot shaft 734 provided in a manner supported by an inner wall of a side face on +Y side of the chassis 740, and is configured to be rotatable in the Y-Z plane about an axis being the pivot shaft 734 together with the arm 733.

As illustrated in FIG. 6, the arm 733 is configured in a bent form such that the arm 733 as is and the second cover 730 do not make contact with the chassis 740 when the second cover 730 pivotally moves between the covering position and the cover opening position, and such that the second cover 730 is fixed at the cover opening position. The arm 733, which is composed of a resin, is provided at a leading end portion of the arm 733, where a fitting portion 735 that makes the arm 733 fit around the pivot shaft 734 is configured as a hook shape. A portion of the hook shape maintains a state of fitting around the pivot shaft 734 due to an elasticity of the resin.

In addition, the hook shape of the fitting portion 735 is configured such that a force acting against the elastic force is exerted on the fitting portion 735 when a force is applied vertically downward to the second cover 730 at the cover opening position. Specifically, as illustrated in FIG. 6, when a force F1 is applied vertically downward to the second cover 730 at the cover opening position, a force in an approximate R direction acts on the arm 733 around a pivoting point being a location at which the chassis 740 abuts against the arm 733, and in conjunction with this, a force F2 acting against the elastic force is exerted on the hook portion that abuts against the pivot shaft 734. The hook shape of the fitting portion 735 is not broken against the force F1 that is assumed as excessive, and is configured as a shape that releases the fitting by the force F2 acting against the elastic force of the hook portion.

Perspective views illustrating an aspect of the printer 100 as a recording apparatus or a specific example of an aspect of the ink storing device 71 as a liquid storing device is illustrated in FIGS. 7 to 13.

Figure 7:
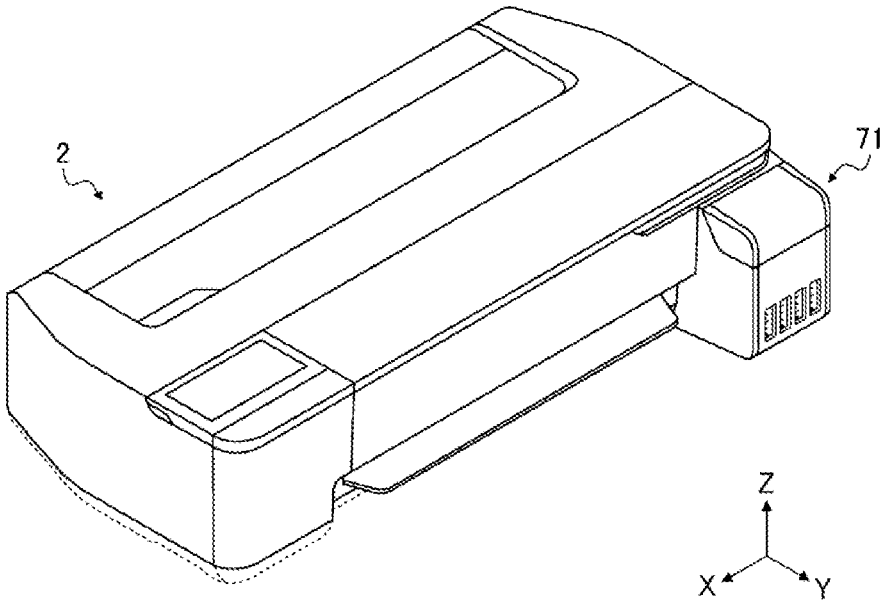
FIG. 7 is a perspective view of a main body of printer apparatus as a recording apparatus.

FIG. 7 is a perspective view of the main body of apparatus 2 of the printer 100.

Figure 8:
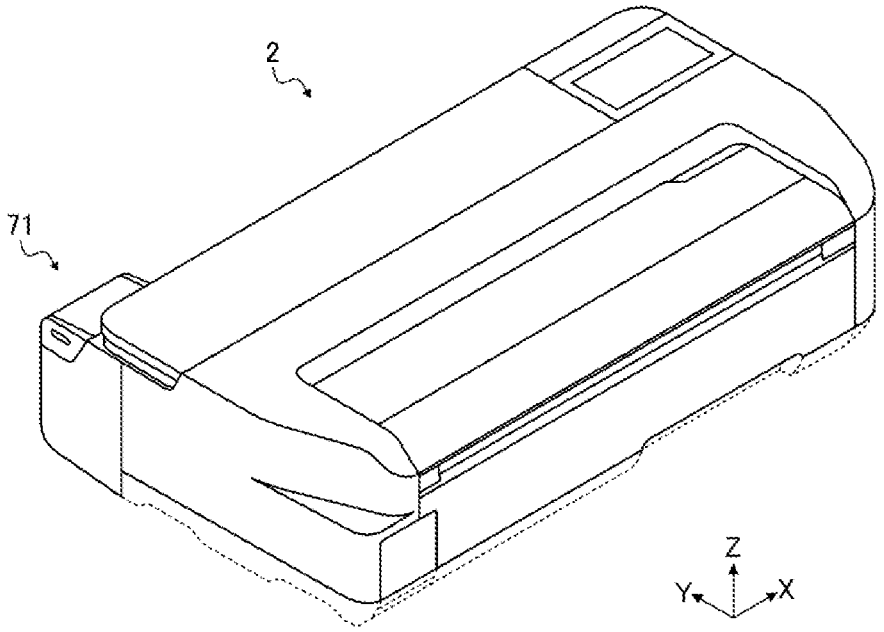
FIG. 8 is a perspective view of a main body of printer apparatus as a recording apparatus viewed from a back face side.

FIG. 8 is a perspective view of the main body of apparatus 2 viewed from a back face side.

Figure 9:
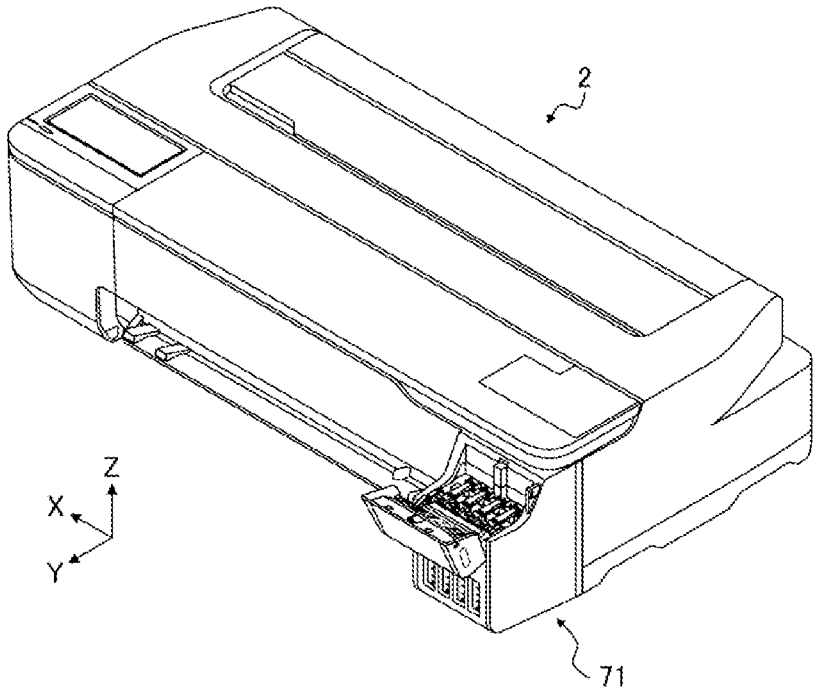
FIG. 9 is a perspective view of a main body of printer apparatus as a recording apparatus viewed in a direction different from that of FIG. 7.

FIG. 9 is a perspective view of the main body of apparatus 2 viewed in a direction different from that of FIG. 7.

Figure 10:
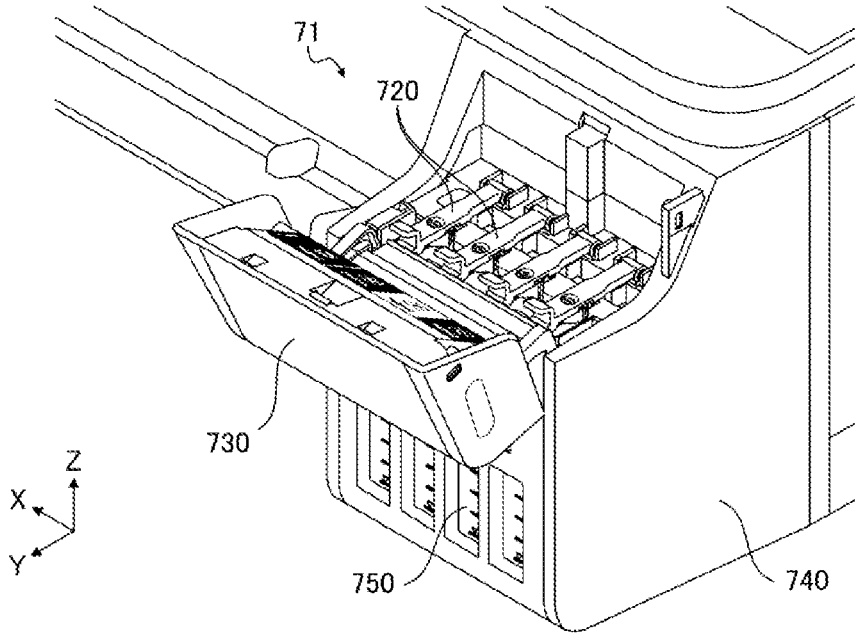
FIG. 10 is a perspective view of an ink storing device as a liquid storing device.

FIG. 10 is a perspective view of the ink storing device 71.

Figure 11:
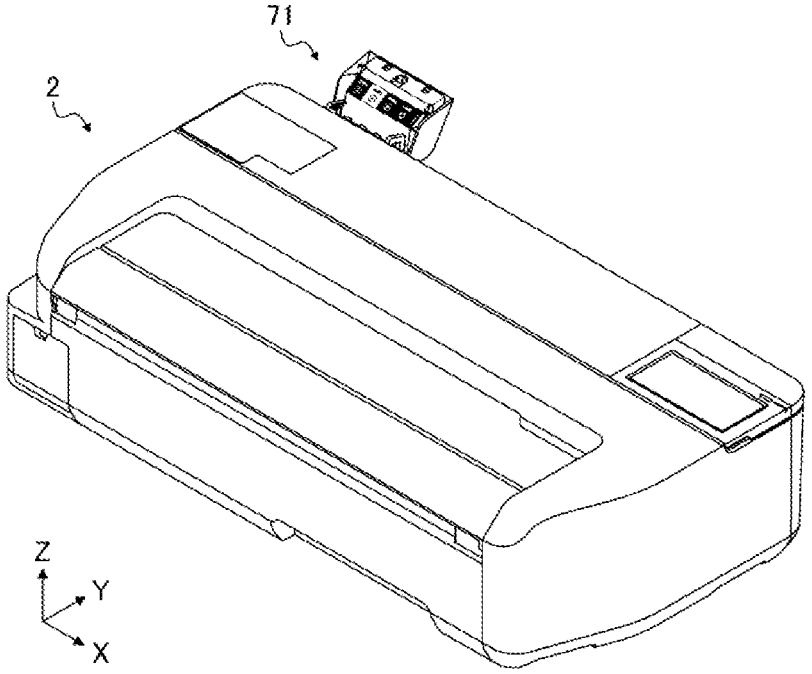
FIG. 11 is a perspective view of a main body of printer apparatus as a recording apparatus viewed from a back face side different from that illustrated in FIG. 8 when a second cover is located at a cover opening position.

FIG. 11 is a perspective view of the main body of apparatus 2 viewed from a back face side different from that of FIG. 8 when the second cover 730 is located at the cover opening position.

Figure 12:
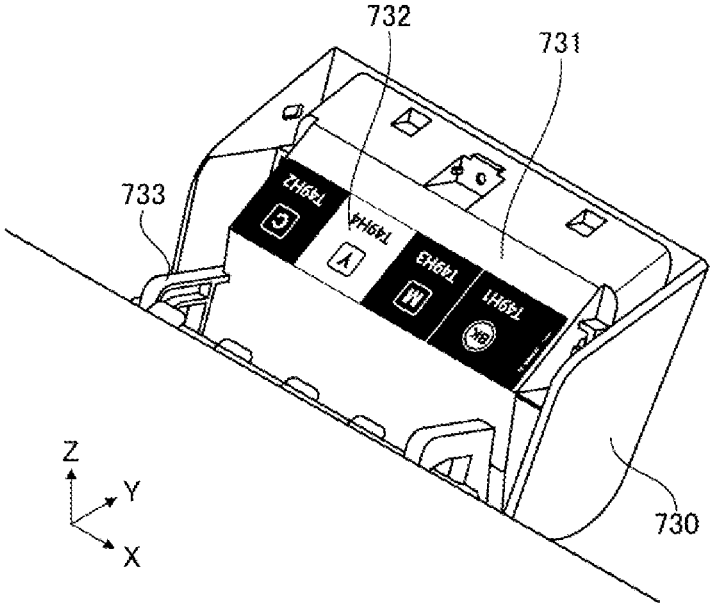
FIG. 12 is a perspective view of an ink storing device as a liquid storing device viewed from a back face side when a second cover is located at a cover opening position.

FIG. 12 is a perspective view of the ink storing device 71 viewed from a back face side when the second cover 730 is located at the cover opening position.

Figure 13:
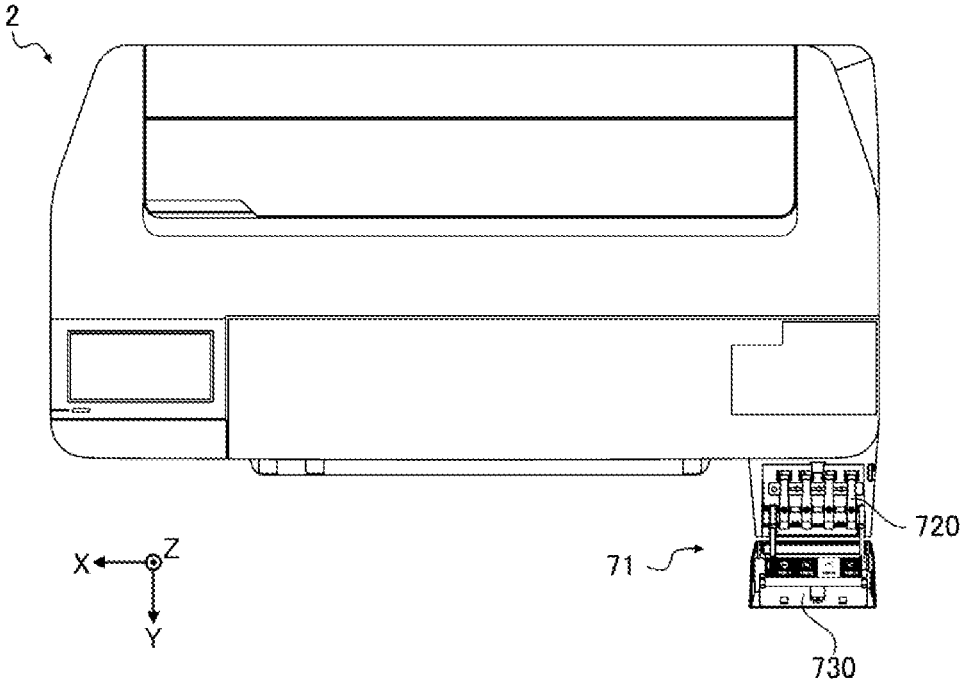
FIG. 13 is a plan view of a main body of printer apparatus as a recording apparatus viewed from upside when a second cover is located at a cover opening position.

FIG. 13 is a plan view of the main body of apparatus 2 viewed from upside when the second cover 730 is located at the cover opening position.

According to Embodiment 1, the following advantageous effects can be achieved.

In the first cover 720, the cap 721 included in the first cover 720 moves between the closing position at which the cap 721 closes the injection port 711 and the opening position at which the cap 721 opens the injection port 711. During the movement, the cap 721 avoids overlapping when viewed in the vertical direction with the display unit 732 included in the second cover 730 at the cover opening position. Accordingly, even when the ink adheres to the cap 721 located upside of the display unit 732 when the second cover 730 is moved to the cover opening position and then the first cover 720 is moved to the opening position to remove the cap 721 from the injection port 711, the display unit 732 is suppressed from becoming contaminated by the ink due to the risk of the ink dropping from the cap 721 onto the display unit 732 becoming less or none. This makes it possible to maintain, when injecting the ink, a visibility of the display unit 732 of the second cover 730 that the display unit 732 can be visually recognized due to the second cover 730 moving to the cover opening position.

Further, in the first cover 720, the cap 721 included in the first cover 720 moves between the closing position at which the cap 721 closes the injection port 711 and the opening position at which the cap 721 opens the injection port 711. During the movement, the cap 721 avoids overlapping when viewed in the vertical direction with the second cover 730 at the cover opening position. Accordingly, even when the ink adheres to the cap 721 located upside of the second cover 730 when the second cover 730 is moved to the cover opening position and then the first cover 720 is moved to the opening position to remove the cap 721 from the injection port 711, the second cover 730 is suppressed from becoming contaminated by the ink due to the risk of the ink dropping from the cap 721 onto the second cover 730 becoming less or none. As a result, even when the display unit 732 is provided at any position at the inner face 731 of the second cover 730, a contamination with the ink is suppressed.

In addition, provided that when an angle formed by a normal line of the inner face 731 provided with the display unit 732 of the second cover 730 at the cover opening position with respect to the horizontal plane is θ, there is obtained Tan θ≥1. That is, the normal line of a surface of the display unit 732 is at an angle in a range from 45 degrees to 135 degrees with respect to the horizontal plane. Thus, information about the ink displayed on the display unit 732 becomes easily visually recognizable from upside.

Further, when the second cover 730 is located at the covering position covering, with the inner face 731 being oriented downward, the first cover 720 at the closing position, the cover opening position at which the second cover 730 avoids covering, with the inner face 731 being inverted, the first cover 720 at the closing position, and a position in between, that is, in a range of a movement of the second cover 730, the position of the display unit 732 is located upside in the vertical direction of the injection port 711 through which the ink is injected. This suppresses the display unit 732 from becoming contaminated with the ink scattered from the injection port 711, the cap 721 removed from the injection port 711, and the like.

Also, even when the second cover 730 is at the cover opening position, the second cover 730 avoids overlapping when viewed in the horizontal direction with the view window 750 through which an interior of the ink tank 710 is viewable. Accordingly, an injection of ink can be performed while confirming an amount of the ink having been injected when injecting the ink into the ink tank 710.

Further, a force acting against the elastic force maintaining a fitting state is exerted on the fitting portion 735 when a force is applied vertically downward to the second cover 730 at the cover opening position. Accordingly, when a force being not less than an assumed magnitude is applied vertically downward to the second cover 730, the fitting portion 735 is removed from the pivot shaft 734, to thus suppress a breakage of the second cover 730.

In addition, the visibility of the display unit 732 configured to display information about the ink is maintained, and thus a recording apparatus usable for a user can be provided.

Contents derived from the embodiment will be described below.

A liquid storing device of the present application includes a liquid storing unit having an injection port through which liquid is injected, a first cover including a cap configured to close the injection port, the first cover being movable between a closing position at which the cap closes the injection port, and an opening position at which the cap opens the injection port, a second cover including, at an inner face thereof, a display unit configured to display information relating to the liquid, the second cover being movable between a covering position at which the inner face covers the first cover at the closing position, with the first cover at the closing position being located at an underside, and a cover opening position at which the inner face does not cover the first cover at the closing position, the inner face being inverted when the second cover moves between the covering position and the cover opening position, wherein the cap, when viewed in a vertical direction, does not overlap the display unit included in the second cover at the cover opening position when the first cover moves between the closing position and the opening position.

According to the above configuration, in the first cover, the cap included in the first cover moves between the closing position at which the cap closes the injection port and the opening position at which the cap opens the injection port. During the movement, the cap avoids overlapping when viewed in the vertical direction with the display unit included in the second cover at the cover opening position. Accordingly, even when the liquid adheres to the cap located upside of the display unit when the second cover is moved to the cover opening position and then the first cover is moved to the opening position to remove the cap from the injection port, the display unit is suppressed from becoming contaminated by the liquid due to the risk of the liquid dropping from the cap onto the display unit becoming less or none. This makes it possible to maintain, when injecting the liquid, a visibility of the display unit of the second cover that the display unit can be visually recognized due to the second cover moving to the cover opening position.

In the liquid storing device described above, the cap, when viewed in the vertical direction, may not overlap the second cover at the cover opening position when the first cover moves between the closing position and the opening position.

According to the above configuration, in the first cover, the cap included in the first cover moves between the closing position at which the cap closes the injection port and the opening position at which the cap opens the injection port. During the movement, the cap avoids overlapping when viewed in the vertical direction with the second cover at the cover opening position. Accordingly, even when the liquid adheres to the cap located upside of the second cover when the second cover is moved to the cover opening position and then the first cover is moved to the opening position to remove the cap from the injection port, the second cover is suppressed from becoming contaminated by the liquid due to the risk of the liquid dropping from the cap onto the second cover becoming less or none. As a result, even when the display unit is provided at any position at the inner face of the second cover, the second cover is suppressed from becoming contaminated by the liquid.

In the liquid storing device described above, when an angle formed by a normal line of an inner face, which is provided with the display unit of the second cover at the cover opening position, with respect to a horizontal plane is $\theta$, there may be obtained $\tan\theta \geq 1$.

According to the above configuration, provided that the angle formed by the normal line of the inner face provided with the display unit of the second cover at the cover opening position with respect to the horizontal plane is $\theta$, there is obtained $\tan\theta \geq 1$. That is, the normal line of the surface of the display unit is at an angle in a range from 45 degrees to 135 degrees with respect to the horizontal plane. Thus, information on the liquid displayed on the display unit becomes easily visually recognizable from upside.

In the liquid storing device described above, when the second cover is located at the covering position, the cover opening position, and a position therebetween, a position of the display unit may be located upside of the filling port in the vertical direction.

According to the above configuration, when the second cover is located at the covering position at which the second cover covers, with the inner face being oriented downward, the first cover at the closing position, the cover opening position at which the second cover avoids covering, with the inner face being inverted, the first cover at the closing position, and a position in between, that is, in a range of the movement of the second cover, the position of the display unit is located upside in the vertical direction of the injection port through which the liquid is injected. This suppresses the display unit from becoming contaminated by the liquid scattered from the injection port, the cap removed from the injection port, and the like.

In the liquid storing device described above, the liquid storing unit may include, at a side face thereof, a view window through which an interior is viewable, wherein when viewed in a horizontal direction, the second cover at the cover opening position may not overlap the view window.

According to the above configuration, even when the second cover is at the cover opening position, the second cover avoids overlapping when viewed in the horizontal direction with the view window through which an interior of the liquid storing unit is viewable. Accordingly, an injection of liquid can be performed while confirming an amount of the liquid having been injected when injecting the liquid into the liquid storing unit.

The liquid storing device may include a pivot shaft pivotally supporting the second cover between the covering position and the cover opening position, in which the second cover may include a fitting portion fitting around the pivot shaft and maintaining a fitting stateby an elastic force, and a force acting against the elastic force may be exerted when a force is applied vertically downward to the second cover that is at the cover opening position.

According to the above configuration, a force acting against the elastic force maintaining the fitting state is exerted on the fitting portion when a force is applied vertically downward to the second cover at the cover opening position. Accordingly, when a force being not less than an assumed value is applied vertically downward to the second cover, the fitting portion is removed from the pivot shaft, to thus suppress a breakage of the second cover.

A recording apparatus of the present application includes the liquid storing device described above, and a recording unit configured to perform recording onto a recording medium by liquid supplied from the liquid storing device.

According to the above configuration, the visibility of the display unit configured to display information about the liquid is maintained, and thus a recording apparatus usable for a user can be provided.

What is claimed is:

1. A liquid storing device, comprising:

a liquid storing unit having an injection port through which liquid is injected;

a first cover including a cap configured to close the injection port, the first cover being movable between a closing position at which the cap closes the injection port, and an opening position at which the cap opens the injection port; and a second cover including, at an inner face thereof, a display unit configured to display information relating to the liquid, the second cover being movable between a covering position at which the inner face covers the first cover at the closing position, with the first cover at the closing position being located at an underside, and a cover opening position at which the inner face does not cover the first cover at the closing position, the inner face being inverted when the second cover moves between the covering position and the cover opening position, wherein the cap, when viewed in a vertical direction, does not overlap the display unit included in the second cover at the cover opening position when the first cover moves between the closing position and the opening position, when the second cover is located at the covering position, the cover opening position, and a position therebetween, a position of the display unit is located upside of the injection port in the vertical direction.

2. The liquid storing device according to claim 1, wherein the cap, when viewed in the vertical direction, does not overlap the second cover at the cover opening position when the first cover moves between the closing position and the opening position.

3. The liquid storing device according to claim 1, wherein the liquid storing unit includes, at a side face thereof, a view window through which an interior is viewable, and when viewed in a horizontal direction, the second cover at the cover opening position does not overlap the view window.

4. The liquid storing device according to claim 1, comprising a pivot shaft pivotally supporting the second cover between the covering position and the cover opening position, wherein the second cover includes a fitting portion fitting around the pivot shaft and maintaining a fitting state by an elastic force, and a force acting against the elastic force is exerted when a force is applied vertically downward to the second cover that is at the cover opening position.

5. A recording apparatus, comprising the liquid storing device according to claim 1, and a recording unit configured to perform recording onto a recording medium by liquid supplied from the liquid storing device.

6. A liquid storing device, comprising:

a liquid storing unit having an injection port through which liquid is injected;

a first cover including a cap configured to close the injection port, the first cover being movable between a closing position at which the cap closes the injection port, and an opening position at which the cap opens the injection port; and a second cover including, at an inner face thereof, a display unit configured to display information relating to the liquid, the second cover being movable between a covering position at which the inner face covers the first cover at the closing position, with the first cover at the closing position being located at an underside, and a cover opening position at which the inner face does not cover the first cover at the closing position, the inner face being inverted when the second cover moves between the covering position and the cover opening position, wherein the cap, when viewed in a vertical direction, does not overlap the display unit included in the second cover at the cover opening position when the first cover moves between the closing position the opening position, when an angle formed by a normal line of an inner face, which is provided with the display unit of the second cover at the cover opening position, with respect to a horizontal plane is $\theta$, there is obtained $\tan\theta \geq 1$.

7. The liquid storing device according to claim 6, wherein the cap, when viewed in the vertical direction, does not overlap the second cover at the cover opening position when the first cover moves between the closing position and the opening position.

8. The liquid storing device according to claim 6, wherein the liquid storing unit includes, at a side face thereof, a view window through which an interior is viewable, and when viewed in a horizontal direction, the second cover at the cover opening position does not overlap the view window.

9. The liquid storing device according to claim 6, comprising a pivot shaft pivotally supporting the second cover between the covering position and the cover opening position, wherein the second cover includes a fitting portion fitting around the pivot shaft and maintaining a fitting state by an elastic force, and a force acting against the elastic force is exerted when a force is applied vertically downward to the second cover that is at the cover opening position.

10. A recording apparatus, comprising the liquid storing device according to claim 6, and a recording unit configured to perform recording onto a recording medium by liquid supplied from the liquid storing device.

* * * * *